United States Patent [19]

Peterson

[11] 4,037,792

[45] * July 26, 1977

[54] CONTINUOUSLY REFINING RAW FIBROUS MATERIAL TO PRODUCE MECHANICAL REFINER PULP

[75] Inventor: Viking Per Peterson, Sundsvall, Sweden

[73] Assignee: SCA Development Aktiebolag, Sundsvall, Sweden

[ * ] Notice: The portion of the term of this patent subsequent to Nov. 25, 1992, has been disclaimed.

[21] Appl. No.: 609,226

[22] Filed: Sept. 2, 1975

Related U.S. Application Data

[63] Continuation of Ser. No. 401,598, Oct. 1, 1973, abandoned.

[30] Foreign Application Priority Data

Oct. 23, 1972 Sweden ..... 13653/72
Apr. 3, 1973 Sweden ..... 7304665

[51] Int. Cl.[2] ..... B02C 23/26; D21B 1/14

[52] U.S. Cl. ..... 241/18; 162/17; 162/23; 162/28; 162/29; 162/47; 162/52; 162/68; 241/28; 241/29

[58] Field of Search ..... 162/17, 47, 23, 29, 162/28, 52, 68; 241/18, 17, 23, 27, 28, 29

[56] References Cited

U.S. PATENT DOCUMENTS

| | | | |
|---|---|---|---|
| 2,957,795 | 10/1960 | Stuck | 162/28 |
| 3,238,088 | 3/1966 | Villavicencio et al. | 162/28 X |
| 3,388,037 | 6/1968 | Asplund et al. | 162/28 X |
| 3,446,699 | 5/1969 | Asplund et al. | 162/28 X |
| 3,910,505 | 10/1975 | Reinhall | 241/18 |

OTHER PUBLICATIONS

"Fasserplaten" (Fiberboards), Lampert, 1967, pp. 310, 311 & 315–318.

*Primary Examiner*—Arthur L. Corbin
*Attorney, Agent, or Firm*—Lerner, David, Littenberg & Samuel

[57] ABSTRACT

Raw fibrous material is preheated in a preheater in the presence of steam under a pressure greater than atmospheric pressure and then continuously introduced into a disc refiner, without prior defibration, whereby steam is generated in said disc refiner. The generated steam is continuously conducted away from said disc refiner as subsequent fibrous material is continuously being introduced into the disc refiner in order to obtain a pressure in the disc refiner which is greater than atmospheric pressure but less than the pressure in said preheater.

8 Claims, 4 Drawing Figures

CONTINUOUSLY REFINING RAW FIBROUS MATERIAL TO PRODUCE MECHANICAL REFINER PULP

Figure 1:
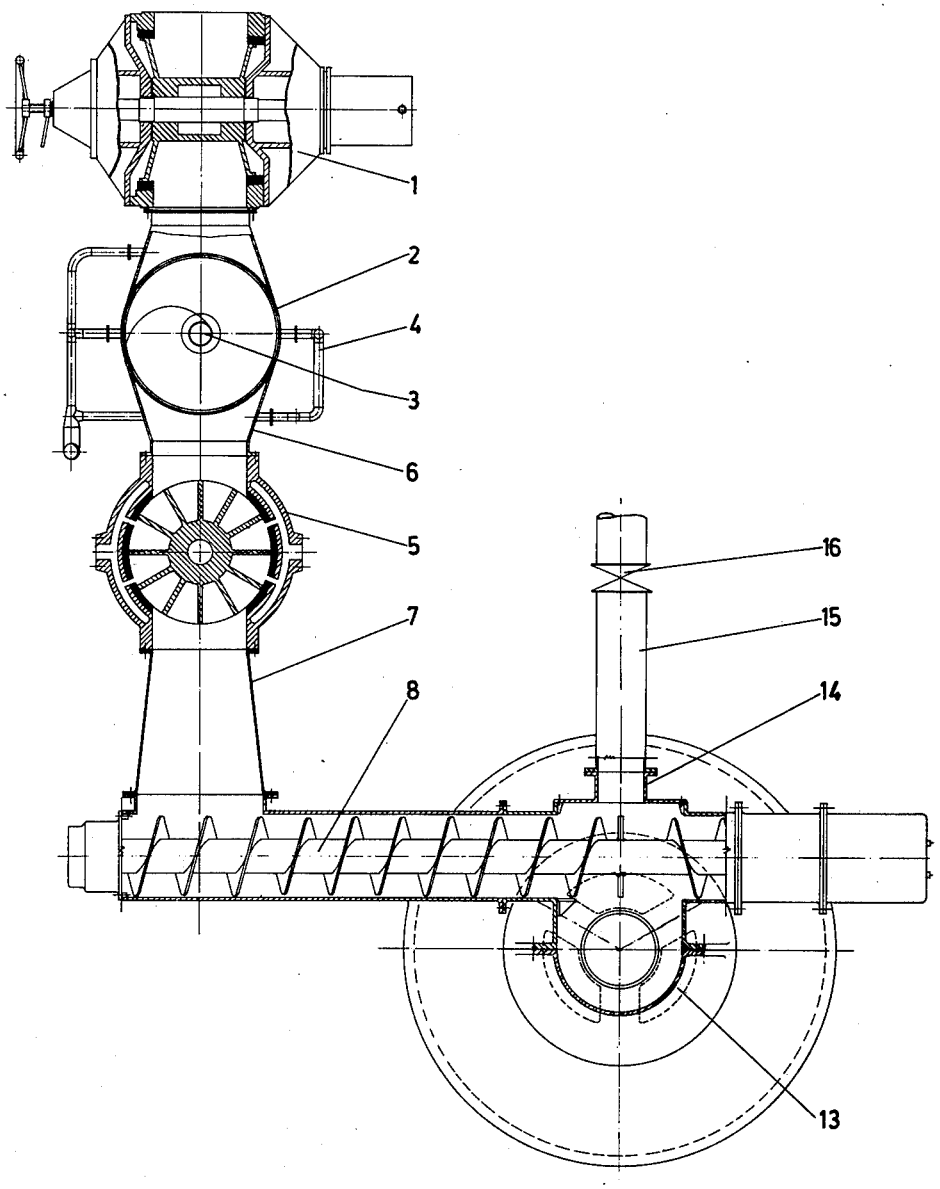

This is a continuation of application Ser. No. 401,598, filed Oct. 1, 1973, now abandoned.

This invention relates to a method and an apparatus for producing mechanical refiner pulp of high quality from various types of fibrous material. By this method, fibre products are obtained with a minimum of energy consumption which show very good quality data and can be utilized for the making of cardboard and paper of a quality meeting very high quality requirements.

It is known that the defibration of fibrous material of different types is facilitated to a high degree when the fibrous material, before it is subjected to mechanical treatment in the refiner, is preheated at increased pressure and temperature for a certain time whereafter the subsequent defibration and refining are carried out at the same pressure and temperature which prevail in the preheating zone of the system. The staying time of the fibrous material in the preheating zone is relatively short and generally not longer than 1–3 minutes. With certain fibrous materials, however, the periods may be longer. It is characteristic of such systems that the pressure and corresponding temperature in the preheating zone are maintained in the space between the defibering means of the refiner, whether they consist of two contrarotating refining surfaces (double-disc refiner) or one rotating and one stationary refining surface (single-disc refiner), and that these refining surfaces are surrounded by a grinding housing, which also is under pressure. It is further characteristic of these systems that the refining process is carried out in at least two steps, whether it is carried out with a double-disc refiner or single-disc refiner, and that the first refining step under pressure is followed by at least one additional refining step under atmospheric pressure. These systems are further characterized in that, due to the first step being carried out entirely closed and under pressure, the whole considerable steam amount, which partly develops during the passage between the refining surfaces and partly can follow along from the preheating zone, must pass out through the relatively narrow gap between these surfaces. This can limit to a high degree the possibilities of increasing the energy consumption in the pressure-refining step, which increase, if it is desired, is brought about by reducing the gap between the refining surfaces. This increases the steam rate between these surfaces, which rate easily attains critical values. In order to prevent the fibrous material from discoloring by the high temperature and from darkening during the transport to and through subsequent refining steps, the fibrous material often must be cooled after the pressure-refining step. This cooling usually involves dilution by water which detrimentally affects the energy consumption in the following atmospheric refining steps. Additions of bleaching agents also prevents a decrease in the brightness of the fibrous material. This, however, involves higher costs.

One main object of the present invention is to bring about an improved system and method of producing mechanical refiner pulps of such a quality, that they can be used also for the making of high-quality printing paper, where heretofore the utilization of such refiner pulps was highly restricted. The invention, besides, has proved advantageous for certain types of final products where very high requirements with respect to the strength properties are to be met but where the requirements as to the brightness of the product are of a minor importance.

According to the invention, the raw material is preheated at high concentration under increased pressure to a temperature exceeding 110° C. The pressure may thereafter expand to a pressure, which exceeds atmospheric pressure, but is lower than and independent of the pressure during preheating. The steam developed during the refining operation can be continuously conducted away entirely or partially by special means from the central space between the grinding discs through passageways in one of the grinding discs and/or rearwards through the charging opening of the refiner and further out through an evacuation conduit. The steam following along from the preheating zone will, of course, also be evacuated through said openings. This implies, contrary to previous systems, a greater freedom in refining with narrower gaps, i.e. with greater energy investments, without serious process disturbances arising due to high steam rates in the gap between the refining surfaces. The refining proper of the fibrous material can thereby be carried out at the pressure and temperature which are most suitable for the process, independently of the pressure having been applied in the preheating zone. By evacuating the steam, which was developed during the refining, by suitable means and to the desired extent, it is possible to maintain the desired pressure in the zone between the refining surfaces, and by being able after the preheating process freely to choose the suitable pressure in the refining zone it is possible, contrary to previous systems, to carry out the entire refining process to the finished product in one single step, i.e. the entire necessary energy is invested in this single step. It is, furthermore, possible, contrary to previous systems, to carry out the process with the housing surrounding the grinding discs being pressureless and open. This renders it possible to use standard refiners with open grinding housing, which thus must not be equipped with a special pressure housing.

It is possible to carry out the refining at lower pressures and temperatures than those prevailing in the preheating zone, because it was found that the softening of the fibrous material, which the preheating process is aimed at, is of such a nature that it remains after the pressure and temperature decrease subsequent to the preheating for a period which is sufficiently long for the fibrous material to be introduced between the refining surfaces and successfully be refined with a minimum of fibre damage.

The method renders it possible to continuously produce very good mechanical refiner pulps with quality properties, which in most cases are sufficiently high for the paper qualities, in which the refiner pulp is supposed to be included as a component. There exist, however, cases, for example in the making of printing paper of a very high grade for coating, where the requirements on the purity of the refiner pulp, i.e. its freedom from undefibrated chip bits (shivers), are so high that the refining process must be carried out in two steps. The energy consumption necessary for the process is hereby so distributed between the two steps that the desired properties of the finished product are obtained and suitably so that the greater part of the necessary energy amount is consumed in the first refining step immediately after the preheating of the chips. The energy amount, which thereby is consumed in the first step, however, even in two-step refining, is in most cases so high that the steam developed during the process can give rise to operation disturbances if the steam, as in previous conventional systems, were to be forced to pass out in its entirety through the gap between the grinding segments.

The remaining part of the energy amount required for carrying out the process is thereafter consumed during the refining in subsequent steps to the finished product. In both steps, refiners with open grinding housings are used.

Figure 2:
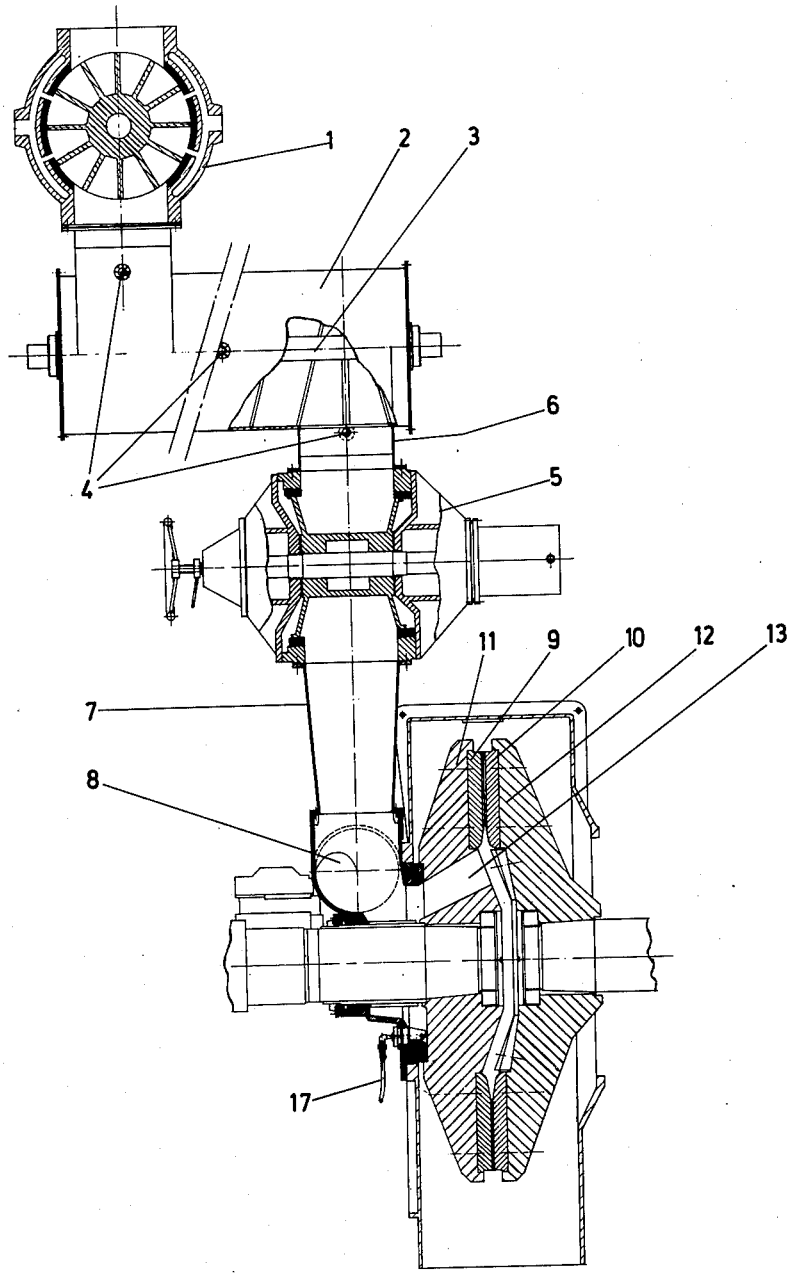
Figure 3:
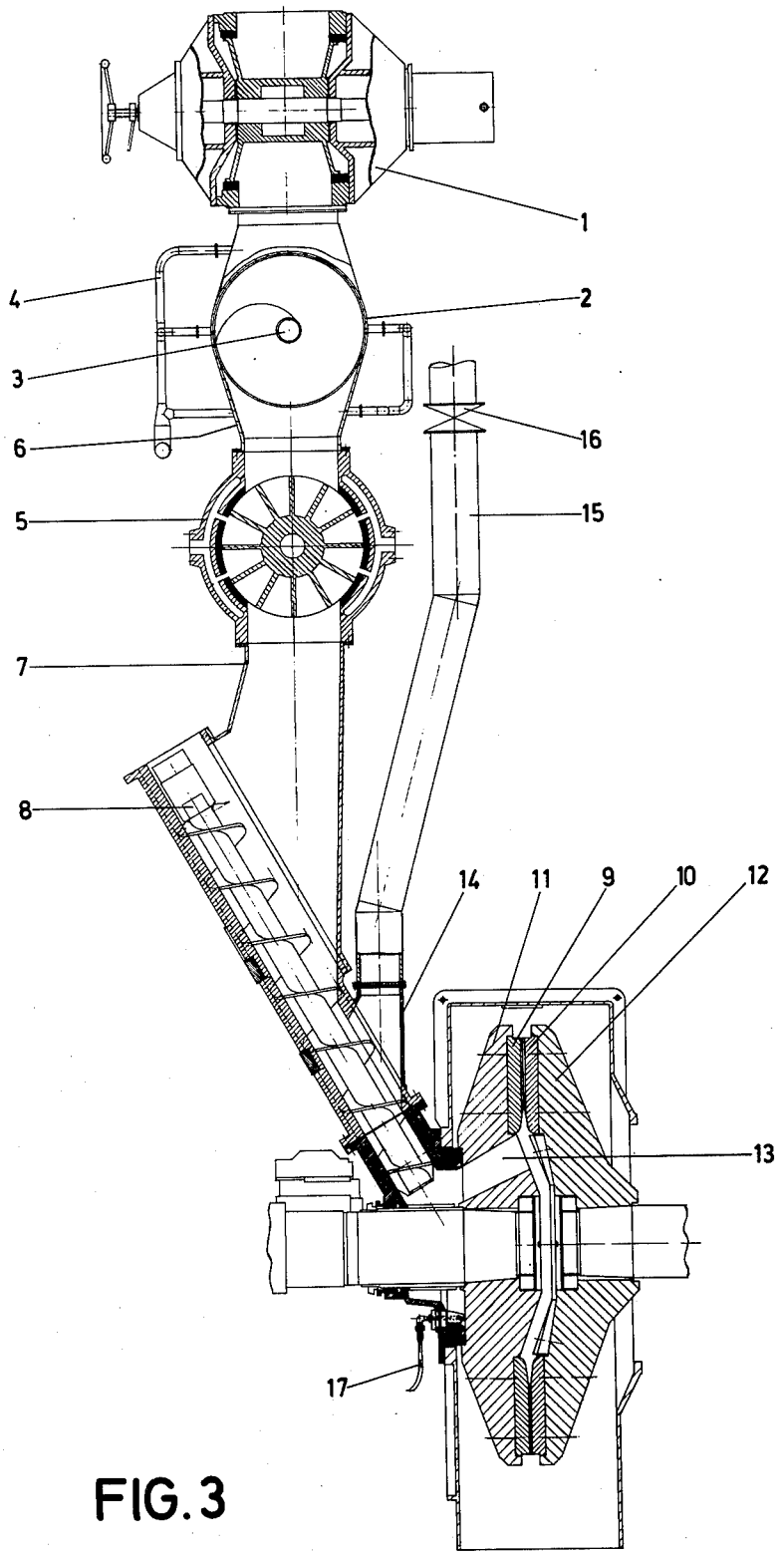
Figure 4:
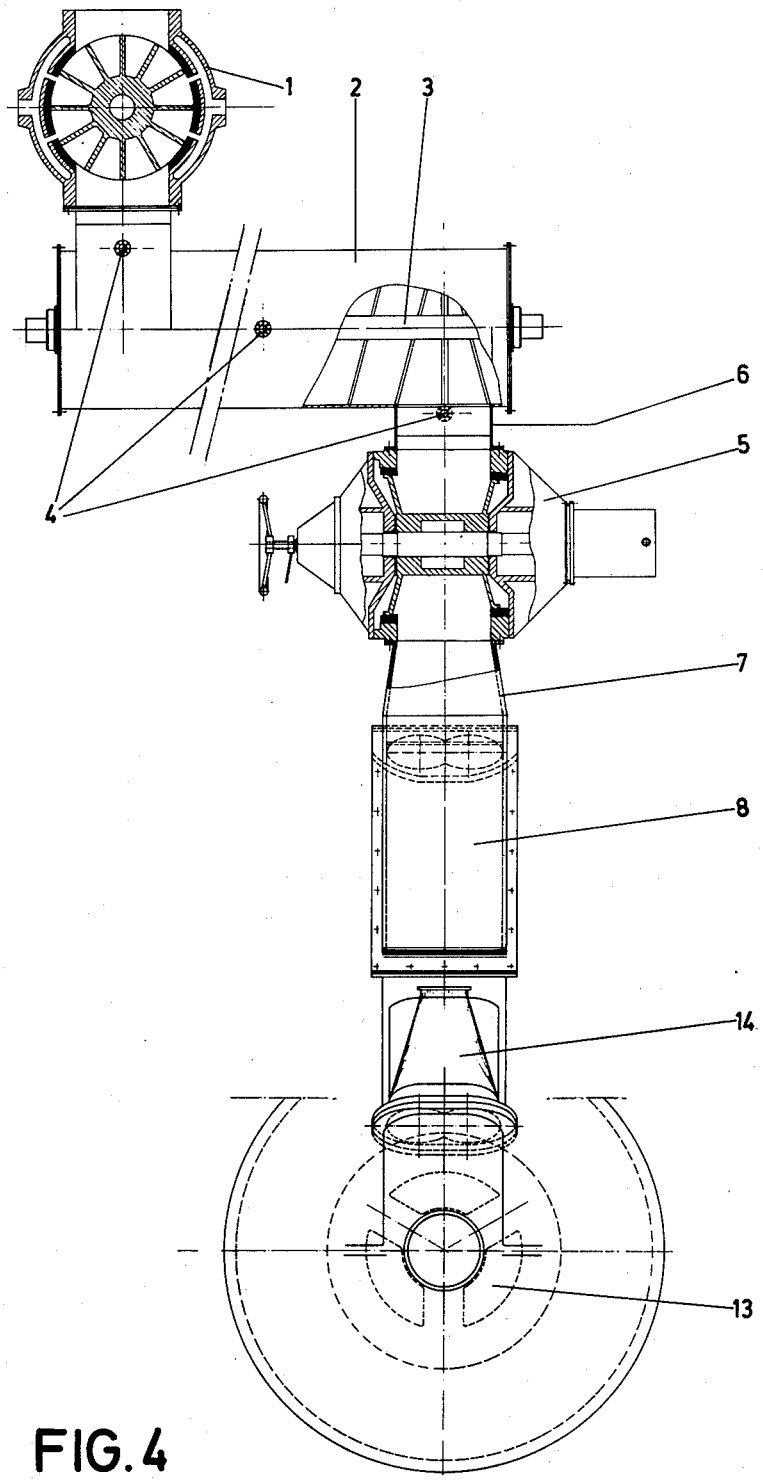

The invention is described in greater detail in the following, with reference to the drawing, in which FIGS. 1 and 2 show two views of an embodiment, and FIGS. 3 and 4 show two views of another embodiment.

The embodiment according to FIGS. 1 and 2 comprises a rotary vane feeder 1 feeding the fibrous material into a preheating vessel 2. The fibrous material is batched in a correct amount for each occasion by a metering screw or belt (not shown) disposed before the rotary vane feeder 1. The fibrous material is advanced through the vessel 2 by a screw 3 with such a speed that the staying time in this preheating vessel is as long as intended. For this purpose the screw 3 is provided with a variable drive. The atmosphere in the vessel bringing about the desired softening of the fibrous material prior to its entering the refiner is effected by the supply of steam through a plurality of conduits 4, which are connected to the preheating vessel 2 along its length.

The rotary vane feeder 1 may also be replaced by a screw which charges the fibrous material in the form of a plug flow. The heated fibrous material is discharged from the preheating vessel 2 by means of a second rotary vane feeder 5, which is connected with the preheating vessel 2 by a chute 6 adjusted to the local conditions, whereafter the fibrous material, via an additional chute 7, is transferred to a horizontal charging screw 8 mounted on the refiner. Said screw 8 is provided with a variable drive and charges the fibrous material through charging opening 13 provided in one of the rotary grinding discs 11, 12 of the refiner which are provided with refining surfaces 9, 10.

On the upper side of the casing of the charging screw 3, adjacent the refiner, a socket 14 is provided to which is connected a steam conduit or line 15 with a control valve 16. The line 15 is suitably connected to a fan means (not shown). The steam developing during the refining process between the rotating refining surfaces 9, 10 has thereby the possibility of leaving the refining zone via the openings 13 and can be evacuated through the line 15, so that not all of the steam developed during the refining process must be transported through the narrow gap between the refining surfaces 9, 10. It is thereby possible, by adjusting the control valve 16 and by a suitable patterning of the rotary refining surfaces, to distribute this steam transport, so that in the refining zone the desired pressure and temperature are established. Compared with previous systems where all of the steam must pass through the gap between the refining surfaces, it is hereby possible to carry out the refining of the fibrous material at substantially smaller gaps between the refining surfaces and in this way to transfer substantially greater energy amounts in the fibrous material without being disturbed by high steam rates in the gap. It is hereby possible to carry out the entire refining process in a single step and at pressures and temperatures, which are chosen freely and independently of the pressure and temperature conditions prevailing in the preheating vessel. By adding water in the normal manner through injection nozzles 17, the refining of the fibrous material can be carried out at the desired fibre concentration.

The embodiment according to FIGS. 3 and 4 is designed in principle in the same way as the above-mentioned embodiment, with the difference, however, that the charging screw 8 is inclined obliquely upwards. Such a charging screw is the most usual commercially available charging device for double-disc refiners, and therefore the system according to the invention can be applied in a very simple manner to already existing refiners. Otherwise, the charging device according to the first embodiment is to be preferred because it can be easier dimensioned according to the process.

In the production of refiner pulps with such a quality as to be applicable to high-quality printing paper, the fibrous material is pre-treated for a relatively short time, $\frac{1}{2}$ – 3 minutes, suitably $\frac{1}{2}$ – $1\frac{1}{2}$ minutes, and is then subjected to a heating to 110° – 140° C, suitably 125° –135° C and a pressure increase corresponding to the temperature.

For other types of finished products where very high requirements with respect to strength properties of the pulp are to be met, but the requirements as to the brightness of the product are of minor importance, the preheating must be carried out at higher temperatures. The temperature in such cases is to be above 140° C, preferably 140° – 170° C. The preheating of word chips within this temperature range brings about a finished product, which is darker than if the preheating were carried out within the range 110° – 140° C, but has improved strength properties. It was, further, found suitable in these cases to prolong the preheating time for the wood chips.

The invention, of course, is not restricted to the embodiments shown, but can be varied within the scope of the claims. The refiner or refiners, for example, may be of the single-disc type of refiner.

I claim:

1. A continuous method of producing a mechanical refiner pulp from raw fibrous material comprising the steps of preheating said fibrous material in a preheater in the presence of steam under a pressure which exceeds atmospheric pressure to a temperature exceeding 110° C., so as to soften said fibrous material, continuously introducing said softened fibrous material through a conduit to a disc refiner to refine said softened fibrous material between refining surfaces of said disc refiner, without prior defibration, whereby steam is generated in said disc refiner during refining of said softened fibrous material, continuously conducting at least a portion of said steam generated in said disc refiner away from said disc refiner as subsequent fibrous material is continuously being introduced between the refining surfaces of said disc refiner in order to obtain a desired pressure between said refining surfaces of said disc refiner and to prevent the entire amount of said steam generated in said disc refiner from passing between the discs thereof said desired pressure being greater than atmospheric pressure, but less than the pressure in said preheater, and maintaining the gap between said refining surfaces such that the preheated fibrous material is refined to produce a mechanical refiner pulp of a sufficiently high quality that can be used for making cardboard or paper.

2. The method of claim 1, wherein said preheating step is carried out at a temperature of between about 110° C and 140° C.

3. The method of claim 1, wherein said preheating step is carried out at a temperature of between about 140° C and 170° C.

4. The method of claim 1, wherein said refining is carried out in a single step.

5. The method of claim 1, wherein said refining is carried out in two steps.

6. The method of claim 1 wherein said disc refiner includes an open and pressureless housing.

7. The method of claim 1 wherein said portion of said steam conducted away from said disc refiner is conducted away through a steam conduit, separate from the conduit through which said softened fibrous material is introduced and controlled, by valve means in said steam conduit.

8. The method of claim 7 wherein said portion of said steam conducted away from said disc refiner is conducted away through said steam conduit by fan means in said steam conduit.

* * * * *

UNITED STATES PATENT OFFICE

CERTIFICATE OF CORRECTION

Patent No. 4,037,792 Dated July 26, 1977

Inventor(s) Viking Per Peterson

It is certified that error appears in the above-identified patent and that said Letters Patent are hereby corrected as shown below:

Column 3, line 44, change "3" to -- 8 --.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*